US008210721B2

(12) United States Patent
Chen et al.

(10) Patent No.: US 8,210,721 B2
(45) **Date of Patent: *Jul. 3, 2012**

(54) LED LAMP MANUFACTURING METHOD

(75) Inventors: Shang-Lin Chen, Banciao (TW); Chih-Hung Hsu, Tu Chen (TW)

(73) Assignee: Everlight Electronics Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,142

(22) Filed: Mar. 31, 2011

(65) Prior Publication Data

US 2011/0176321 A1 Jul. 21, 2011

Related U.S. Application Data

(63) Continuation of application No. 12/473,630, filed on May 28, 2009, now Pat. No. 7,979,984.

(30) Foreign Application Priority Data

Nov. 24, 2008 (TW) ..... 97145394 A

(51) Int. Cl.
*F21V 3/00* (2006.01)
*F21V 5/00* (2006.01)

(52) U.S. Cl. ..... 362/311.02; 362/653; 362/800

(58) Field of Classification Search ..... 362/249.02, 362/249.06, 249.14–249.19, 311.02, 653–654, 362/800

See application file for complete search history.

(56) References Cited

U.S. PATENT DOCUMENTS

| | | | | |
|---|---|---|---|---|
| 5,330,368 | A * | 7/1994 | Tsuruzono | 439/409 |
| 5,681,409 | A * | 10/1997 | Lin et al. | 156/73.1 |
| 6,283,612 | B1 | 9/2001 | Hunter | |
| 6,566,824 | B2 | 5/2003 | Panagotacos et al. | |
| 6,793,369 | B2 | 9/2004 | Calzaretta et al. | |
| 6,932,495 | B2 | 8/2005 | Sloan et al. | |
| 6,948,827 | B2 | 9/2005 | Tally | |
| 7,213,961 | B2 | 5/2007 | Hyder | |
| 7,217,012 | B2 | 5/2007 | Southard et al. | |
| 7,377,669 | B2 | 5/2008 | Farmer et al. | |
| 7,506,995 | B2 | 3/2009 | Thomas et al. | |
| 7,665,861 | B2 | 2/2010 | Blumel et al. | |
| 2008/0298058 | A1 | 12/2008 | Kan et al. | |

FOREIGN PATENT DOCUMENTS

| | | | |
|---|---|---|---|
| CN | 1773785 | A | 5/2006 |
| CN | 2831526 | Y | 10/2006 |

* cited by examiner

*Primary Examiner* — Jason Moon Han
(74) *Attorney, Agent, or Firm* — Han IP Law PLLC; Andy M. Han

(57) ABSTRACT

An improved LED lamp manufacturing method and an improved LEP lamp device are described. In one aspect, an LEP lamp device includes an LED lamp bulb, a pair of electrical cables electrically coupled to the LED lamp bulb, and a main body. The main body encloses part of the LED lamp bulb, part of the pair of cables, a connection between the LED lamp bulb, and the pair of electrical cables. The main body includes a first plastic member and a second plastic member coupled to the first plastic member. Each of the first plastic member and second plastic member has a respective pair of cable grooves. The first plastic member or the second plastic member, or both, have one or more welding lines along an edge and between the respective pair of cable grooves.

17 Claims, 4 Drawing Sheets

LED LAMP MANUFACTURING METHOD

RELATED APPLICATIONS

This application is a continuation of U.S. patent application Ser. No. 12/473,630 entitled "LED Lamp Manufacturing Method", filed May 28, 2009 and issued as U.S. Pat. No. 7,979,984 on Jul. 19, 2011, which claims priority to Taiwan Patent Application Serial Number 097145394, filed Nov. 24, 2008, which applications are herein incorporated in their entirety by reference.

BACKGROUND

1. Technical Field

The present disclosure relates to a lamp manufacturing method. More particularly, the present disclosure relates to an LED (Light Emitting Diode) lamp manufacturing method.

2. Description of Related Art

Christmas lamp is one of the most important decorative ornaments on the Christmas tree, and LED based Christmas lamps are popular Christmas products.

A conventional LED based Christmas lamp manufacturing method is to electrically couple the LED lamp bulb with a pair of electrical cables, and then to injection mold the coupled portions to be watertight sealed such that the electrical cables would not result in a short circuit.

As the last step of the manufacturing method is to quench the injection molded thermoplastic materials, it often takes a while for the injection molded thermoplastic materials to be adequately solid before packaging the LED based Christmas lamp and shipping out to the client. This would be a disadvantage for a large, rush order before the holidays like Christmas. For the forgoing reasons, there is a need for improving the manufacturing method for LED based Christmas lamps.

SUMMARY

It is therefore an objective of the present disclosure to provide an LED lamp manufacturing method.

In accordance with the foregoing and other objectives of the present disclosure, an LED lamp manufacturing method is provided to include the following steps. An LED lamp bulb and a pair of electrical cables are provided. The LED lamp bulb is electrically coupled with the pair of electrical cables. A main body is provided to enclose the LED lamp bulb, wherein the main body consists of a first plastic member and a second plastic member. The first plastic member is coupled with the second plastic member.

Thus, the present disclosure provides an LED lamp manufacturing method which utilizes the ultrasonic welding process to couple two separate plastic members and which is equipped with the following benefits: (1) reducing the queue time for rush to the market; and (2) readily adaptable in automatic manufacturing to save labor costs.

It is to be understood that both the foregoing general description and the following detailed descriptions are by examples, and are intended to provide further explanation of the present disclosure as claimed.

BRIEF DESCRIPTION OF THE DRAWINGS

The accompanying drawings are included to provide a further understanding of the present disclosure, and are incorporated in and constitute a part of this specification. The drawings illustrate embodiments of the present disclosure and, together with the description, serve to explain the principles of the present disclosure. In the drawings.

DESCRIPTION OF THE PREFERRED EMBODIMENTS

Figure 1:
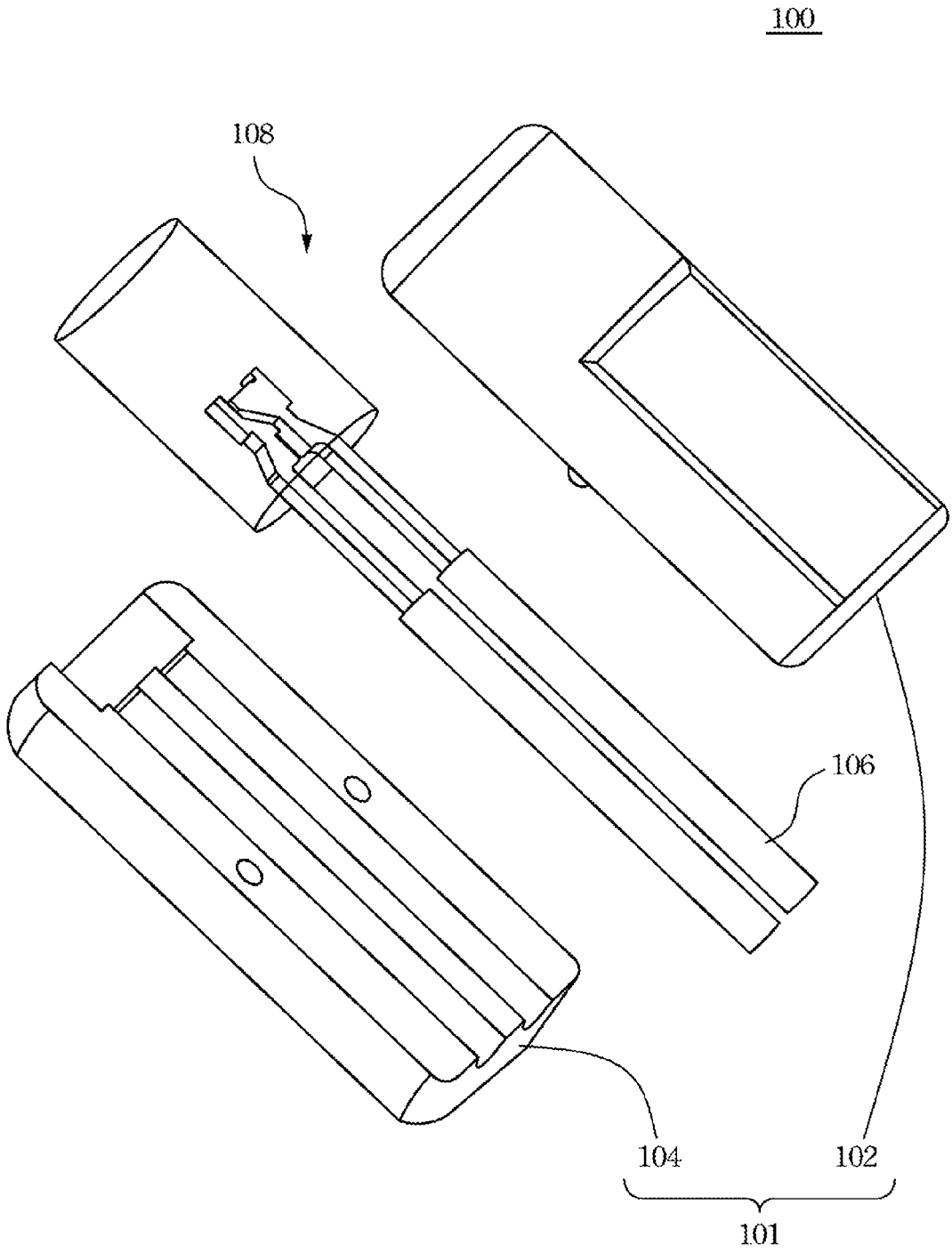
FIG. 1 illustrates an exploded view of an LED lamp according to one embodiment of this present disclosure.

Reference will now be made in detail to the present preferred embodiments of the present disclosure, examples of which are illustrated in the accompanying drawings. Wherever possible the same reference numbers are used in the drawings and the description to refer to the same or like parts.

FIG. 1 illustrates an exploded view of an LED lamp according to one embodiment of this present disclosure. The LED lamp 100 includes a main body 101, a pair of electrical cables 106 and an LED lamp bulb 108, wherein the main body 101 consists of a first plastic member 102 and a second plastic member 104. The main body 101 is to enclose the LED lamp bulb 108 and part of the electrical cables 106. The LED lamp bulb 108 is electrically coupled with the pair of electrical cables 106.

Figure 2:
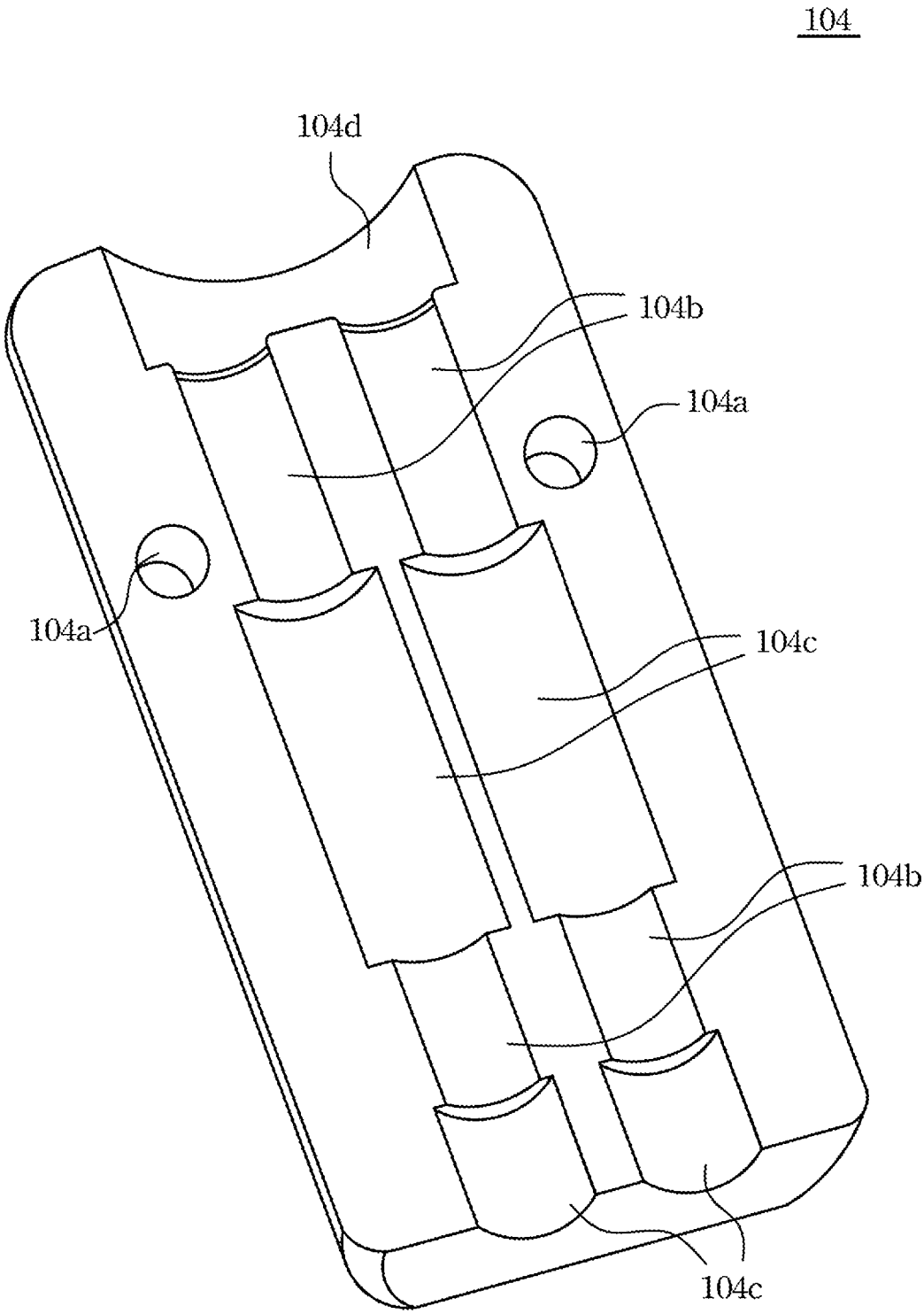
FIG. 2 and FIG. 3 respectively illustrate two enlarged views of two plastic half members in FIG. 1.
Figure 3:
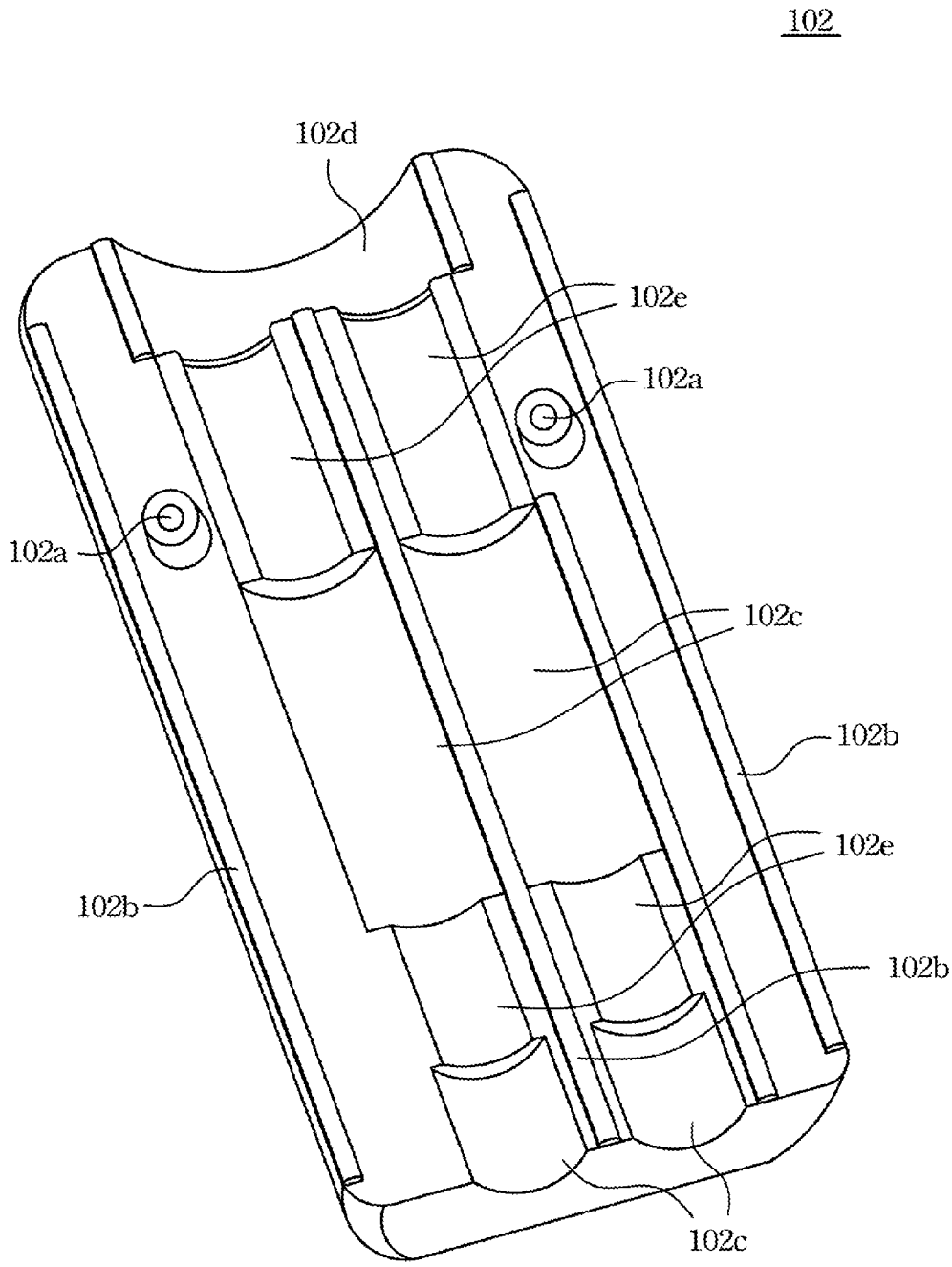

FIG. 2 and FIG. 3 respectively illustrate two enlarged views of two plastic members in FIG. 1. The second plastic member 104 has a pair of alignment holes 104*a* symmetrically located on two edges of a welding surface thereof and correspondingly disposed to each other. The first plastic member 102 has a pair of alignment pins 102*a* symmetrically located on two edges of a welding surface thereof. When the first plastic member 102 is coupled with the second plastic member 104, each alignment pin 102*a* engages with a respective alignment hole 104*a* such that two plastic members are properly aligned and assembled for a subsequent welding process. In this embodiment, a lamp groove (102*d*, 104*d*) is respectively formed on an end of the first plastic member 102 and the second plastic member 104. Each of the lamp grooves (102*d*, 104*d*) may have a semi-circular inner surface or other curved inner surface. When the first plastic member 102 is coupled with the second plastic member 104, two lamp grooves (102*d*, 104*d*) are combined to form a hollow space, i.e. a circular hole between the first and second plastic members, to accommodate the LED lamp bulb 108.

FIG. 2 and FIG. 3 show cable grooves (104*b*, 104*c*) are formed on the welding surface of the second plastic member 104 while cable grooves (102*c*, 102*e*) are formed on the welding surface of the first plastic member 102. Each cable groove can be of single one diameter along the whole section or different diameters at different sections. In the second plastic member 104, a pair of cable grooves are located between two alignment holes 104*a*. Each cable groove is of different diameters at different sections, e.g. the cable groove 104*c* has a bigger diameter than that of the cable groove 104*b*. A predetermined distance is formed between the pair of cable grooves and along the alignment holes 104*a* of the second plastic member 104. In the first plastic member 102, a pair of cable grooves are located between two alignment pins 102*a*. Each cable groove is of different diameters at different sections, i.e. the cable groove 102*c* has a bigger diameter than that of the cable groove 102*e*. A predetermined distance is formed between the pair of cable grooves and along the alignment pins 102*a* of the first plastic member 102. When the first plastic member 102 is coupled with the second plastic member 104, the pair of cables 106 are respectively accommodated within the cable grooves and watertight sealed (after an ultrasonic welding process). Since the cable grooves are apart from each other by an interval, the pair of cables 106 can be electrically isolated from each other. It should be noted that the cable grooves (102*c*, 104*c*) of bigger diameters accommodate not only the cables 106, but also excess melted plastic materials during the ultrasonic welding process. Thus, the excess melted plastic materials tends to flow into the cable grooves (102*c*, 104*c*) to seal the pair of cables 106, rather than flow out to the outer surface of the first plastic member 102 or the second plastic member 104.

In this embodiment, welding lines 102*b* are formed along edges and between the pair of cable grooves of the first plastic member 102 to be melted as glues during the ultrasonic welding process. Welding lines can also be formed on the second plastic member 104 alone or on both the first plastic member 102 and second plastic member 104.

Figure 4:
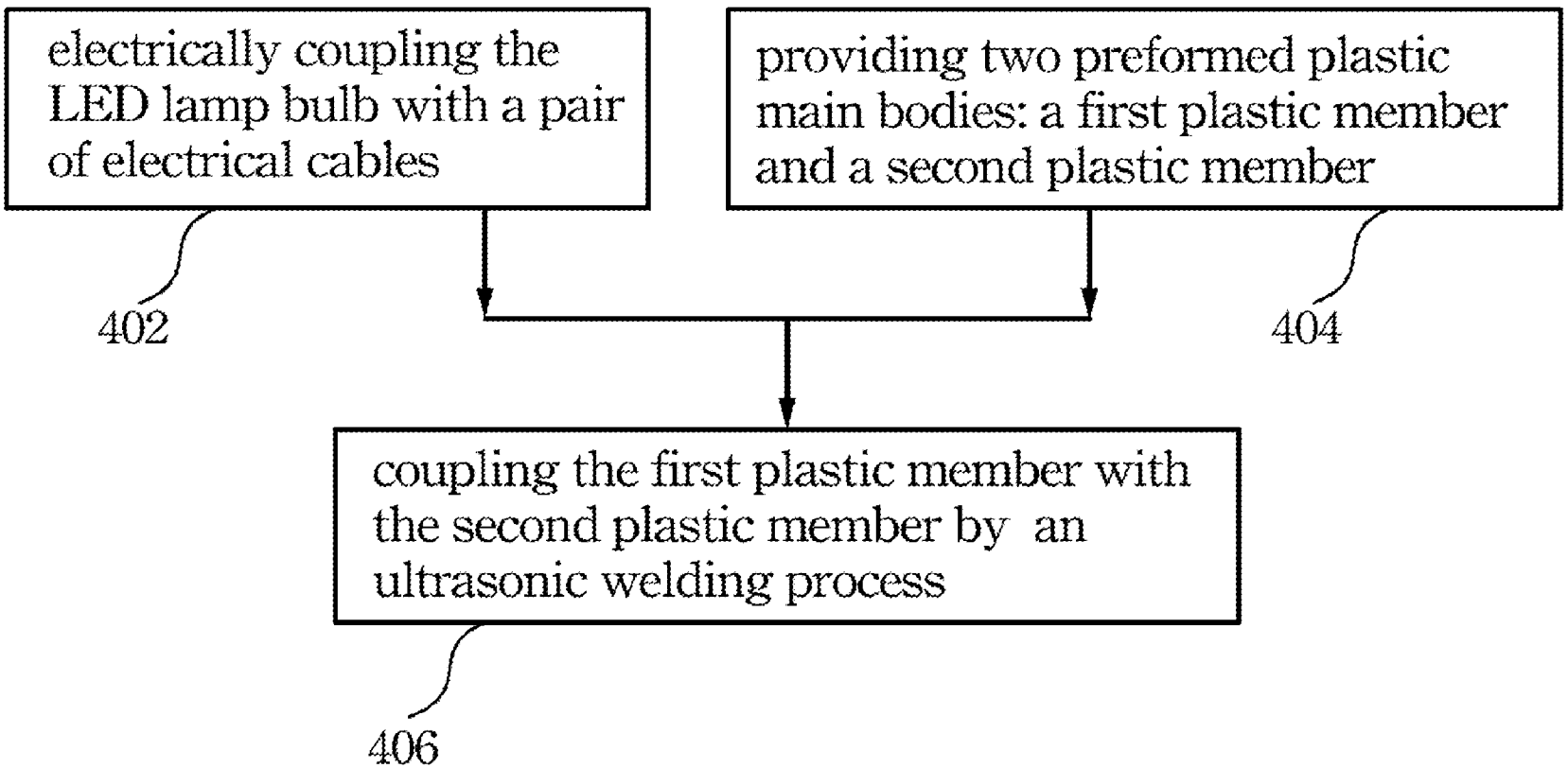
FIG. 4 illustrates a manufacturing flowchart of the LED lamp according to one embodiment of this present disclosure.

FIG. 4 illustrates a manufacturing flowchart of the LED lamp according to one embodiment of this present disclosure. In step 402, the LED lamp bulb is electrically coupled with a pair of electrical cables. In step 404, two preformed plastic main bodies: a first plastic member and a second plastic member. Basically, the step 402 and step 404 can be separately preformed at the same time or at different times (e.g. the step 402 is executed after the step 404 or the step 404 is executed after the step 402). In step 406, the first plastic member and the second plastic member are assembled to enclose the LED lamp bulb and form a cylindrical main body. Finally, the high-frequency ultrasonic acoustic vibrations are applied to the first plastic member and the second plastic member, which are held together under pressure, so as to create a solid-state weld of the plastic main body. By using the ultrasonic welding process in manufacturing the LED lamp, the queue time for the LED lamp can be shortened.

According to discussed embodiments, the present disclosure provides an LED lamp manufacturing method, which utilizes the ultrasonic welding process to couple two separate plastic members, such that the queue time for the LED lamp can be greatly reduced in order to be rushed to the market during holidays like Christmas.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims and their equivalents.

What is claimed is:

1. An LED lamp device, comprising:

an LED lamp bulb;

a pair of electrical cables electrically coupled to the LED lamp bulb; and a main body enclosing part of the LED lamp bulb, part of the pair of electrical cables, and a connection between the LED lamp bulb and the pair of electrical cables, the main body including a first plastic member and a second plastic member coupled to the first plastic member, each of the first plastic member and second plastic member having a respective pair of cable grooves, the first plastic member or the second plastic member, or both, having one or more welding lines along an edge thereof and between the respective pair of cable grooves.

2. The device of claim 1, wherein the first plastic member further includes a plurality of alignment pins, wherein the second plastic member further includes a plurality of alignment holes, and wherein the alignment pins are correspondingly disposed to the alignment holes when the second plastic member is coupled to the first plastic member.

3. The device of claim 2, wherein the pair of cable grooves are disposed between the alignment pins of the first plastic member and between the alignment holes of the second plastic member.

4. The device of claim 3, wherein a first predetermined distance is formed between the alignment pins of the first plastic member and across the pair of cable grooves, and wherein a second predetermined distance is formed between the alignment holes of the second plastic member and across the pair of cable grooves.

5. The device of claim 2, wherein the pair of electrical cables are respectively disposed within the pair of cable grooves.

6. The device of claim 2, wherein the pair of cable grooves are of a single diameter.

7. The device of claim 2, wherein the pair of cable grooves are of different diameters.

8. The device of claim 1, wherein at least two lamp grooves are respectively formed on an end of the first plastic member and the second plastic member, and wherein the lamp grooves are combined to form a hollow space to accommodate the LED lamp bulb.

9. The device of claim 1, wherein the first plastic member is coupled with the second plastic member by an ultrasonic welding process.

10. An LED lamp device, comprising:

an LED lamp bulb;

a pair of electrical cables electrically coupled to the LED lamp bulb; and a main body enclosing part of the LED lamp bulb, part of the pair of electrical cables, and a connection between the LED lamp bulb and the pair of electrical cables, the main body including a first plastic member and a second plastic member coupled to the first plastic member, the first plastic member coupled with the second plastic member by an ultrasonic welding process, wherein each of the first plastic member and second plastic member further includes a respective pair of cable grooves, and wherein each of the first plastic member and the second plastic member further comprises one or more welding lines along an edge thereof and between the respective pair of cable grooves.

11. The device of claim 10, wherein the first plastic member further includes a plurality of alignment pins, wherein the second plastic member further includes a plurality of alignment holes, and wherein the alignment pins are correspondingly disposed to the alignment holes when the second plastic member is coupled to the first plastic member.

12. The device of claim 11, wherein the pair of cable grooves are disposed between the alignment pins of the first plastic member and between the alignment holes of the second plastic member.

13. The device of claim 12, wherein a first predetermined distance is formed between the alignment pins of the first plastic member and across the pair of cable grooves, and wherein a second predetermined distance is formed between the alignment holes of the second plastic member and across the pair of cable grooves.

14. The device of claim 11, wherein the pair of electrical cables are respectively disposed within the pair of cable grooves.

15. The device of claim 11, wherein the pair of cable grooves are of a single diameter.

16. The device of claim 11, wherein the pair of cable grooves are of different diameters.

17. The device of claim 10, wherein at least two lamp grooves are respectively formed on an end of the first plastic member and the second plastic member, and wherein the lamp grooves are combined to form a hollow space to accommodate the LED lamp bulb.

* * * * *